US007866948B1

(12) United States Patent
Liang

(10) Patent No.: US 7,866,948 B1
(45) Date of Patent: Jan. 11, 2011

(54) TURBINE AIRFOIL WITH NEAR-WALL IMPINGEMENT AND VORTEX COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 608 days.

(21) Appl. No.: 11/506,073

(22) Filed: Aug. 16, 2006

(51) Int. Cl.
*F01D 5/18* (2006.01)

(52) U.S. Cl. ..... 416/97 R

(58) Field of Classification Search ..... 415/115; 416/96 R, 97 R
See application file for complete search history.

(56) References Cited

U.S. PATENT DOCUMENTS 3,644,059 A * 2/1972 Bryan ..... 416/97 R
4,293,275 A 10/1981 Kobayashi et al.
4,669,957 A 6/1987 Phillips et al.
5,700,131 A 12/1997 Hall et al.
5,702,232 A 12/1997 Moore
5,720,431 A 2/1998 Sellers et al.
5,931,638 A 8/1999 Krause et al.
6,264,428 B1 7/2001 Dailey et al.
6,379,118 B2 4/2002 Lutum et al.
6,582,194 B1 6/2003 Birkner et al.
6,769,866 B1 8/2004 Kannefass et al.
6,981,846 B2 1/2006 Liang

* cited by examiner

*Primary Examiner*—Nathaniel Wiehe
(74) *Attorney, Agent, or Firm*—John Ryznic

(57) ABSTRACT

A turbine airfoil includes a plurality of cooling modules formed on the outer surface of the airfoil wall and spaced along the pressure side and the suction side of the airfoil. Each cooling module includes a first diffusion cavity connected to the cooling supply cavity by a first metering hole to provide impingement cooling in the first diffusion cavity. On the sides of the first diffusion cavity are second and third vortex chambers connected to the first diffusion cavity by second and third metering holes. The first diffusion cavity and the two vortex chambers each include film cooling holes to provide film cooling to the airfoil wall. The cooling circuit provides an impingement cooling in series with vortex cooling in order to provide a more efficient cooling of the airfoil wall.

20 Claims, 2 Drawing Sheets

TURBINE AIRFOIL WITH NEAR-WALL IMPINGEMENT AND VORTEX COOLING

CROSS-REFERENCE TO RELATED APPLICATIONS

This application is related to a U.S. Regular utility application Ser. No. 11/506,072 filed concurrently with this application.

BACKGROUND OF THE INVENTION

1. Field of the Invention

The present invention relates generally to fluid reaction surfaces, and more specifically to the cooling of airfoils in a gas turbine engine.

2. Description of the Related Art Including Information Disclosed Under 37 CFR 1.97 and 1.98

In a gas turbine engine, a compressor supplies compressed air to a combustor and burned with a fuel to produce a hot gas flow, which is then passed through a turbine to produce mechanical energy. The efficiency of the engine can be increased by passing a higher temperature flow through the turbine. The limiting factor is the temperature of the flow is the material properties used in the hot parts of the turbine. Typically, the rotor blades and stationary vanes of the first stage are exposed to the hottest gas flow. These parts are cooled by passing cooling air through complex passages formed within the airfoils. The engine efficiency can also be increased by using less cooling air flow through the cooled airfoils. The cooling air is usually bleed off air from the compressor. Use of bleed off air for cooling means less compressed air is available for combustion.

U.S. Pat. No. 5,702,232 issued to Moore on Dec. 30, 1997 entitled COOLED AIRFOILS FOR A GAS TURBINE ENGINE discloses an airfoil having a cooling supply channel formed by an inner wall of the airfoil (as represented in FIG. 1 of this application), and a plurality of radial feed passages positioned between the inner wall and the outer wall of the airfoil. Each feed passage is connected to the cooling supply passage by a re-supply hole, and each feed passage includes a film cooling hole connected to the airfoil outer surface. The Moore patent provides for near-wall cooling of the airfoil wall. However, this cooling construction, spanwise and chordwise cooling flow control due to airfoil external hot gas temperature and pressure variation is difficult to achieve. Also, a single pass radial channel flow is not the best method of utilizing cooling air, resulting is low convective cooling effectiveness.

U.S. Pat. No. 6,981,846 B2 issued to Liang on Jan. 3, 2006 entitled VORTEX COOLING OF TURBINE BLADES discloses an airfoil with a cooling supply passage formed by an inner wall of the airfoil (as represented in FIG. 2 of this application), and a plurality of radial extending vortex cooling chambers positioned between the inner wall and the outer wall of the airfoil. Three radial vortex chambers are connected in series, with the upstream-most chamber connected to the cooling supply channel and the downstream-most vortex chamber connected to a film cooling hole. The multi-vortex cell serves to generate a high coolant flow turbulence level and, hence, yields a very high internal convection cooling effectiveness in comparison to the single pass construction of the prior art. The Liang U.S. Pat. No. 6,981,846 B2 is incorporated herein by reference.

It is an object of the present invention to provide for a near-wall cooling for a turbine airfoil which will reduce the airfoil metal temperature and therefore reduce the cooling flow requirement and improve the turbine efficiency.

BRIEF SUMMARY OF THE INVENTION

The turbine airfoil of the present invention provides for near-wall cooling using multiple impingement-vortex cooling chambers connected in series in the airfoil main body. The multiple impingement-vortex cooling arrangement is constructed in small module formation. The individual module is designed based on the airfoil gas side pressure distribution in both chordwise and spanwise directions. Also, each individual module can be designed based on the airfoil local external heat load to achieve a desired local metal temperature. The multiple impingement-vortex cooling module can be designed in a single or a double vortex formation depending on the airfoil heat load and metal temperature requirement. The individual small modules can be constructed in a staggered or in-lined array along the airfoil main body wall. With the cooling construction of the present invention, the maximum usage of the cooling air for a given airfoil inlet temperature and pressure profile is achieved. Also, the multiple impingement-vortex modules generates high coolant flow turbulence level and yields a very high internal convection cooling effectiveness that the single pass radial flow channel used in the Prior Art near-wall cooling design.

DETAILED DESCRIPTION OF THE INVENTION

Figure 1:
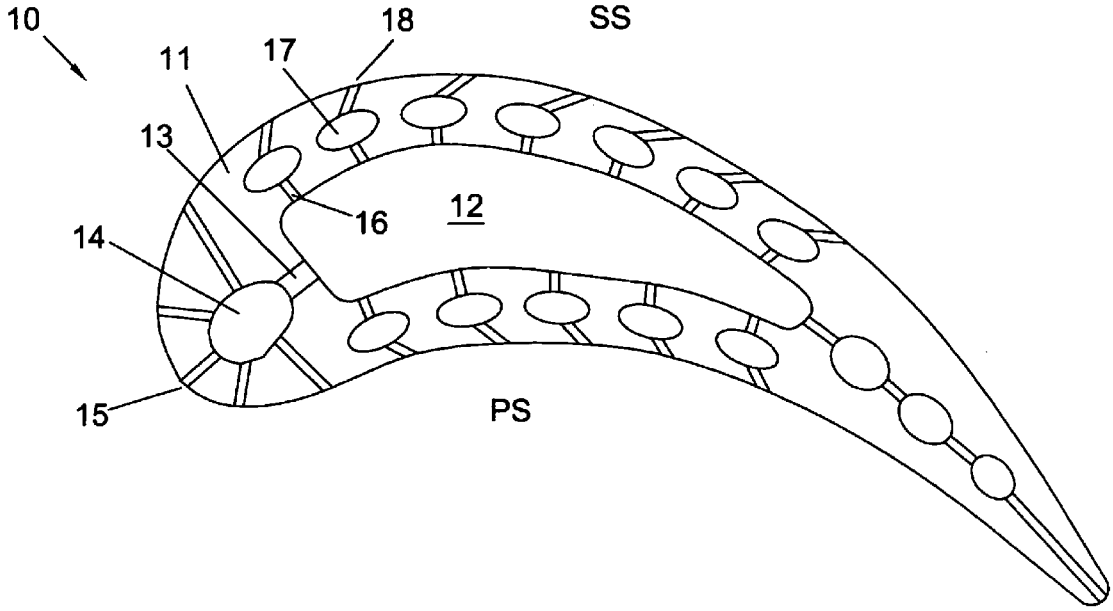
Fig 1 Prior Art
FIG. 1 shows q cross section view of an airfoil of the Prior Art Moore U.S. Pat. No. 5,702,232.
Figure 2:
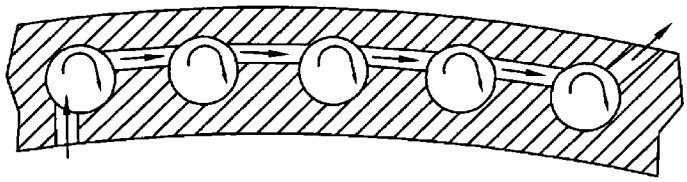
Fig 2 Prior Art
FIG. 2 shows a cross section view of the Prior Art of the Liang U.S. Pat. No. 6,981,846 B2.
Figure 3:
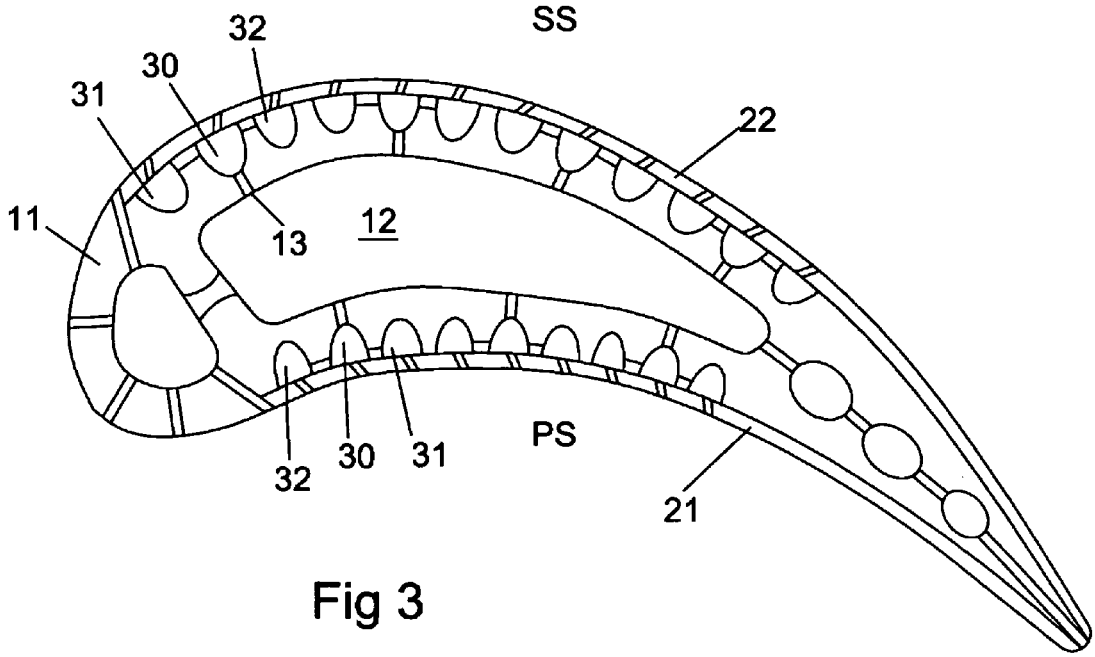
FIG. 3 shows a cross section view of the airfoil and cooling circuit of the present invention.

The turbine airfoil of the present invention is shown in FIG. 3. The airfoil can be either a rotor blade or a stationary vane used in a gas turbine engine. The airfoil includes a body 11 formed by an inner cooling supply cavity 12, and a pressure side 21 and a suction side 22 wall. A showerhead cooling circuit is located on the leading edge portion of the blade and takes the form of the prior art showerhead cooling circuit. The outer surface of the body on the pressure and suctions sides includes a plurality of vortex chambers and diffusion cavities, each chamber having a film cooling hole to discharge cooling air onto the airfoil surface. The vortex chambers are formed into modules, with a plurality of modules arranged along the airfoil walls.

Figure 4:
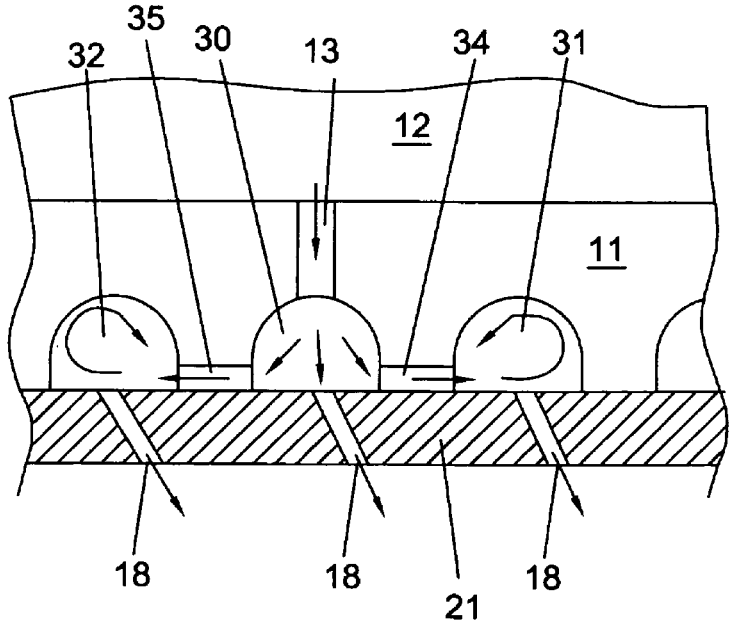
FIG. 4 shows a detailed view of one of the multiple impingement-vortex cooling passages of the FIG. 3 airfoil.

FIG. 4 shows a detailed view of the multiple impingement-vortex cooling circuit of FIG. 3. The airfoil wall 11 includes a vortex module formed on the outer wall surface and includes a central diffusion cavity 30 with an impingement and metering hole 13 connected to the cooling supply channel 12, an upstream (in the hot gas flow direction) diffusion cavity and vortex chamber 32 connected to the central diffusion cavity 30 by a bleed hole 35, and a downstream diffusion cavity and vortex chamber 31 connected to the central diffusion cavity 30 by a bleed hole 34. all three cavities (30,31,32) act as diffusion cavities, while the chambers (31,32) function as vortex chambers. Each of the diffusion cavities (30,31,32) include at least one film cooling hole 18 to discharge cooling air onto the airfoil surface. The film cooling holes 18 are formed in the outer wall surface 21 and are slanted in the direction of the hot gas flow over the airfoil walls. The impingement holes 13, bleed holes 34 and 35, and film cooling holes 18 are staggered in the radial direction of the airfoil in order to produce the vortex flow within the chambers as described in the Liang U.S. Pat. No. 6,981,846.

The central diffusion cavity 30 forms a first diffusion cavity, and the hole 13 forms a first impingement and metering hole 13. The two vortex chambers 31 and 32 form a second diffusion and cavity vortex chamber in series with the central diffusion chamber 30. The bleed holes 34 and 35 form second metering holes in series with the first impingement and metering hole 13.

The operation of the cooling modules of the present invention is as follows. Cooling air is supplied to the cooling supply channel 12 and passes through the impingement holes 13 into the central diffusion cavity 30 and produces an impingement cooling effect within the central diffusion cavity 30. Some cooling air passes through the film cooling hole 18 in the central diffusion cavity and exits onto the airfoil wall. Some of the cooling air passes into the upstream side diffusion cavity and vortex chamber 32 through a bleed hole 35 and out the film cooling 18 associated with this chamber 32. The remaining cooling air passes into the downstream diffusion cavity and vortex chamber 31 through the bleed hole 34, and then out the film cooling hole 18. The cooling air flow within the chambers 34 and 35 adjacent to the central diffusion cavity 30 flows in a vortex path and generates the vortex cooling within the chambers (31,32). The chambers in flow series (30 to 31, or 30 to 32) produce an impingement cooling effect followed by a vortex cooling effect in order to generate the high coolant flow turbulence level and yield a very high internal convection cooling effect than would the cited prior art references.

The airfoil using the chambers of the present invention can also be easily manufactured. The chambers and the metering holes can be formed into the outer surface of the body 11 when the body is cast without requiring machining. A thin outer airfoil wall 21 can then be placed to form the chambers and metering holes 34 and 35.

FIG. 4 shows the inner wall 11 and the airfoil surface 21 to be made of two separate parts. However, the diffusion cavity and vortex chambers can be formed in a solid wall that forms both the inner wall cooling supply channel and the outer airfoil surface.

I claim the following:

1. A turbine airfoil comprising:

a turbine wall having an inner surface forming a cooling supply channel and an outer surface forming the airfoil surface;

a first diffusion cavity formed in the wall;

a first metering hole connecting the cooling supply channel to the first diffusion cavity;

a first film cooling hole connected to the first diffusion cavity;

a first vortex chamber formed in the wall and adjacent to the first diffusion cavity;

a second metering hole connecting the first diffusion cavity to the first vortex chamber;

the second metering hole being formed between the inner surface and the outer surface such that convection cooling of the outer surface occurs within the second metering hole;

the first diffusion cavity and the first vortex chamber being arranged along the airfoil chordwise direction; and, a second film cooling hole connected to the first vortex chamber.

2. The turbine airfoil of claim 1, and further comprising:

the second metering hole and the second film cooling hole are offset in order to produce a vortex flow in the first vortex chamber.

3. The turbine airfoil of claim 1, and further comprising:

the first metering hole and the first film cooling hole are offset in order to produce an impingement cooling air flow in the first diffusion cavity.

4. The turbine airfoil of claim 1, and further comprising:

a second vortex chamber located adjacent to the first diffusion cavity and on the opposite side from the first vortex chamber;

a third metering hole connecting the first diffusion cavity to the second vortex chamber;

a third film cooling hole connected to the second vortex chamber; and, the first diffusion cavity, the first vortex chamber and the second vortex chamber all being arranged along the airfoil chordwise direction.

5. The turbine airfoil of claim 4, and further comprising:

the first and second vortex chambers are also diffusion cavities.

6. The turbine airfoil of claim 4, and further comprising:

the second and third metering holes are formed between the airfoil body and the airfoil wall.

7. The turbine airfoil of claim 4, and further comprising:

a plurality of vortex modules arranged along the pressure side wall and the suction side wall of the airfoil; and, each module including the first diffusion cavity and the first and second vortex cavities on the two chordwise sides of the first diffusion cavity.

8. The turbine airfoil of claim 4, and further comprising:

the airfoil wall is a thin wall airfoil and is bonded to the airfoil main body.

9. The turbine airfoil of claim 1, and further comprising:

the film cooling holes are slanted in a direction of the flow over the airfoil surface.

10. The turbine airfoil of claim 1, and further comprising:

the first diffusion cavity and the first vortex chamber are located on the pressure side or the suction side of the airfoil.

11. The turbine airfoil of claim 10, and further comprising:

a plurality of first diffusion cavities and first vortex chambers are arranged along the pressure side wall and the suction side wall to provide cooling for the airfoil.

12. The turbine airfoil of claim 1, and further comprising:

the first metering hole and the first diffusion cavity and the first vortex chamber and the second metering hole are all formed within the wall of the airfoil;

the wall of the airfoil includes a thin airfoil that forms the airfoil surface and encloses the diffusion cavity and the vortex chamber; and, the film cooling holes are formed within the thin airfoil surface.

13. The turbine airfoil of claim 1, and further comprising:

the second metering hole is formed along an inner surface of an outer airfoil surface such that the metering cooling air also produces convection cooling of the outer airfoil surface.

14. A turbine airfoil having a leading edge and a trailing edge, and a pressure side and a suction side, the airfoil having a wall with an inner surface forming a cooling supply cavity, the turbine airfoil comprising:

a plurality of cooling modules spaced along the pressure side and the suction side of the airfoil, each module including:

a first diffusion cavity with a first metering hole connected to the cooling supply cavity;

a second and third vortex chambers located on adjacent sides of the first diffusion cavity, the second vortex chamber being connected to the first diffusion cavity by a second metering hole, and the third vortex chamber being connected to the first diffusion cavity by a third metering hole;

the second and third metering holes being formed between the inner surface and the outer surface such that convection cooling of the outer surface occurs within the second and third metering holes;

the first diffusion cavity and the two vortex chambers each having at least one film cooling hole to discharge cooling air onto the airfoil surface; and, the first diffusion cavity and the second and third vortex chambers that form a single module are arranged along the blade chordwise direction with the third vortex chamber located upstream from the first diffusion cavity and the second vortex chamber located downstream from the first diffusion cavity.

15. The turbine airfoil of claim 14, and further comprising:

the second and third vortex chambers are also diffusion cavities.

16. The turbine airfoil of claim 14, and further comprising:

the second and third metering holes are positioned along the airfoil wall to provide cooling to the wall.

17. The turbine airfoil of claim 14, and further comprising:

the first metering hole and the film cooling hole connected to the first diffusion cavity are radially offset in order to provide impingement flow within the first diffusion cavity.

18. The turbine airfoil of claim 14, and further comprising:

the metering holes in the second and third vortex chambers are radially offset from the respective film cooling holes in order to provide a vortex flow within the vortex chambers.

19. The turbine airfoil of claim 14, and further comprising:

the airfoil includes a leading edge cooling circuit and a trailing edge cooling circuit; and, the cooling modules extend from substantially the leading edge cooling circuit to the trailing edge cooling circuit.

20. The turbine airfoil of claim 14, and further comprising:

the airfoil includes a rib that separates a first cooling supply cavity from a second cooling supply cavity; and, some of the cooling modules are in fluid communication with the first cooling supply cavity while other cooling supply modules are in fluid communication with the second cooling supply cavity.

* * * * *